US005083412A

United States Patent [19]

Sakaki et al.

[11] Patent Number: 5,083,412

[45] Date of Patent: Jan. 28, 1992

[54] METHOD OF REMOVING IDLE STRAPPING BAND FOR STRAPPING MACHINE

[75] Inventors: Tasunori Sakaki, Tokyo; Tsutomu Tagomori, Kanagawa, both of Japan

[73] Assignee: Strapack Corporation, Tokyo, Japan

[21] Appl. No.: 653,208

[22] Filed: Feb. 7, 1991

[30] Foreign Application Priority Data

Feb. 9, 1990 [JP] Japan ..... 2-29988

[51] Int. Cl.[5] ..... B65B 13/06

[52] U.S. Cl. ..... 53/399; 53/64; 53/589; 100/2; 100/29

[58] Field of Search ..... 53/64, 67, 399, 582, 53/589; 100/2, 25, 29, 32

[56] References Cited

U.S. PATENT DOCUMENTS

| | | | |
|---|---|---|---|
| 4,910,945 | 3/1990 | Fujii | 100/29 |
| 4,912,912 | 4/1990 | Tagomor | 53/589 |
| 4,955,180 | 9/1990 | Sakaki | 53/64 X |

*Primary Examiner*—John Sipos

*Attorney, Agent, or Firm*—Joseph C. Mason, Jr.; Ronald E. Smith

[57] ABSTRACT

This invention provides a method of removing an idle strapping band in which a band restored and retracted by a reverse rotation roller is wound around the end of a slide table forms a ring of the band in case of no article to be strapped and engaged with the band on a strapping machine body, a rotation reduction detection signal of the reverse rotation roller is not generated before the setting time of a timer is completely elapsed before the band is tightened, a band tightening step is then omitted, shifted to next cutting and fusing steps of the band supplying end, the ring of the band is then recoiled upward by means of elastic force for restoring the ring of the band to a true circle when the end of the slide table is retracted along guide rails and the band is automatically removed out of a band fusing mechanism. A band tightening is executed by a tension arm, a cam shaft is normally rotated to be stopped before the band is fused after the band supplying end is cut, the cam shaft is then reversely rotated to its original position, the holding of the end and supplying end of the band wound around the end of the slide table and tightened is relieved, and the band is recoiled above the slide table by means of the elastic force of the band itself and the tightened tension force to be removed.

8 Claims, 6 Drawing Sheets

METHOD OF REMOVING IDLE STRAPPING BAND FOR STRAPPING MACHINE

FIELD OF THE INVENTION

The present invention relates to a method of removing a band at the time of idle strapping for a strapping machine and, more particularly, to a method of removing a band from a slide table when a strapping band is returned by a pair of rollers for returning the band in a body to be wound around the slide table due to an erroneous operation of a starting button if there is no article to be strapped with a band on the strapping machine.

The conventional strapping machine is provided, as illustrated in FIGS. 6 to 8, with a cam shaft 4 directly connected to the output shaft 2 of a speed reducer 31 which is connected to a motor (not shown) through the intermediary of an electromagnetic clutch. The cam shaft 4 is supported by frames 34*a* and 34*b* arranged in an adequately spaced relation; a number of cams 35 are attached to the cam shaft 4 so as to engage respective press members 6 provided between the frames 34*a* and 34*b* and a band guide 7. Limit cams 41 are secured, by means of a screw to a limit cam shaft 40 extended from the outer shaft 4 of the speed reducer 31 in a direction opposite to the frame 34*a* for being capable of adjusting the positions of the convex portions of the limit cams 41. Limit switches L3, L2, and L2 attached, through the intermediary of bracket 34, to positions wherein switch rods can be pressed by means of the convex portions of a plural number of limit cams 41*a*, 41*b*, and 41*c*. Such a structure is known from U.S. Pat. No. 4,912,912.

In a situation illustrated in FIG. 6 showing the original positions of the respective members, the cam shaft motor starts rotation when a starting switch (not shown) is turned ON to cause the cam shaft 4 and the cams 35 to be rotated through the intermediary of the speed reducer 31 whereby a pressing portion 61 on the right side portion in the press members 6 grasps the front end of the band between the pressing portion 61 and the slide table 8.

In this case, the limit cam 41*b* which rotates in synchronism with the cam shaft 4 turns the limit switch L1 ON to produce a reverse rotation signal which stops the cam shaft motor and starts the reverse rotation of a motor which is coupled to a feed roller 43 and connected to a drive control circuit. The feed roller 43*a* and a touch roller 43*b* restore or retract the band, which is removed from a band guiding arch on the main body of the strapping machine and is pulled against the article to be strapped. In a tightening method effected by the tension arm system illustrated in the drawings, the amount of band restoration in the reverse rotation system is set to a desired amount by means of the given setting time of a timer which is operated by the reverse rotation signal of the limit switch L1. After the passage of the setting time of the timer, the reverse rotation of the motor coupled to the feed roller 43 is stopped and the cam shaft motor begins to rotate again. The cam shaft 4 thus rotates and causes the tension arm 44 grasps the band and swings at a predetermined degree of stroke, whereby the band is tightened by the tension arm 44. A pressing portion 62 is displaced by the cam 35 and grasps the band feeding end. A heater (not shown) on a heater crank 18 is displaced as a pressing portion 63 is raised and the tension arm 44 is slightly restored to release the band-tightening state. The edge of a cutter in the pressing portion 63 smoothly cuts the band and joined portions are pressed and fused together by the heater. The middle pressing portion 63 is temporarily lowered to remove the heater and then raised, and the joined band portions are then pressed and fused for a definite time, whereupon the respective members are restored to the original position in FIG. 6 together with the band guide 7, the slide table 8, and the left band way flap 42. The limit cam 41*c* on the limit cam shaft 40 is also rotating in this case and the limit switch L2 is turned ON by means of the limit cam 41*c* concurrently with the restoration of the respective members to the original position thereby producing a forward rotation signal to forward rotate the motor such that the feed roller 43 feeds the band into the guide arch.

The limit switch L2 produces only a signal of the start of the forward rotation thereof and the cam shaft 4 continues rotation at the start of the forward rotation on the way of the restoration of the tension arm 44. The restoration of the tension arm 44 to a state as illustrated in FIG. 7(B) by means of the further swing thereof turns the limit switch L3 ON by means of the limit cam 41*a* on the limit cam shaft 40 to stop the cam shaft motor because of the signal on the original position. In the meanwhile, the forward rotation of the feed roller 42 feeds the band to the band guiding arch on the main body whereby the front end of the band has reached below the slide table 8. One rotation of the cam shaft effects above one strapping cycle.

Generally in the strapping machine, when an article to be strapped is placed on the working table of the strapping machine and the starting switch is turned ON, a band restoring (primary tightening) of restoring the band supplied into the band guide arch attached to the strapping machine body by means of a band restoring and tightening mechanism in the body to remove the band from the arch and winding the band on an article to be strapped, and a band tightening (secondary tightening) for further binding the restored band are conducted, the band supplying end side is then cut, the leading end of the band is fusion-bonded to the joined portion of the supplying end of the band, and the article to be strapped is strapped by the band.

However, a strapping without article (hereinafter referred to as "an idle strapping") might occur due to the delay of the movement of the article to be strapped during a continuous strapping work of an automatic strapping line, etc., such as, for example, an erroneous pressing of a starting switch by an operator, removal of the band from the article to be strapped during the strapping work.

In a conventional strapping machine, if an idle strapping occurs, the band is wound around the slide table to be fusion-bonded by the band restoring and tightening mechanism. Even if the slide table is retracted, the band ring is not removed from the end of the slide table but is disposed in a winding state. Accordingly, the idle strapping disturbs next strapping work, and it is necessary to remove the band ring by scissors.

Guide rails are s provided that both side edges of the slide table are brought into slide contact therewith. It is considered that, when the slide table is retracted, the side edge of the band ring is brought into contact with the end face of the guide rail, and when the slide table is further retracted, the band ring is removed from the end of the slide table. Even in this case, since the band ring is tightened on the slide table, it is formed to be momentarily permanently bent in a shape along the sectional shape of the slide table. Thus, the removed band ring is dropped on the press member under the slide table to retain in the band grasping and fusion-bonding mechanism. Therefore, there arises a problem that, when an initial band is supplied in next strapping step, this band is brought into contact with the press member so that the band cannot be supplied.

In case of the idle strapping, if the slide table is set in the degree of not tightening by a timer for determining the reverse rotation time of the feed roller, a large band ring is formed, and one end of the band ring is automatically stayed on the press member when the slide table is retracted. Accordingly, the one end of the band ring is interposed between the press member and the slide table by means of the restoration of the slide table, the leading end of the band fed by next band supplying step collides with the retaining band to disturb it.

OBJECT OF THE INVENTION

It is an object of the present invention to provide a method of removing an idle strapping band for a strapping machine for removing the band restored and retracted to be wound on a slide table in case of idle strapping at the opposite side of a press member out of the slide table, i.e., through the slide table.

In order to achieve the above object, according to the present invention, a timer operating when a reverse rotation roller starts reverse rotation for restoring and retracting a plastic band having an elasticity and rotating speed detecting means for detecting a reduction in the rotating speed of the reverse rotation roller are provided, and there is provided a method of removing a band comprising the steps of winding the band restored and retracted by the reverse rotation roller on the end of the slide table, so setting the setting time of the timer as to finish the setting time until the slide table is tightened, omitting the band tightening of the band tightening mechanism when the rotating speed detecting means does not generate a rotating speed reduction detection signal of the reverse rotation roller within the setting time of the timer, cutting and fusing the band supplying end by the band cutting and fusing mechanism to form a band ring wound on the end of the slide table, removing the band ring from the leading end of the slide table by retracting both side edges of the slide table in slide contact with the guide rails, and removing the band ring out of an upward recoiling band fusing mechanism by means of the elastic force of the band itself.

According to another aspect of a method of removing a band of the present invention, there is provided according to the present invention a method of removing an idle strapping band comprising the steps of normally rotating a cam shaft when the rotating speed detecting means does not generate a rotating speed reduction detection signal of the reverse rotation roller within a timer setting time to slide the tension arm to cut the band supplying end by a band cutting mechanism, then stopping the normal rotation of the cam shaft before the band is fused by a band fusing mechanism, and then reversely rotating the cam shaft to an original position to remove the cut band out of the upward recoiling band fusing mechanism by means of the elastic force of the band itself tending to restore the annular band in plane when the cut band wound on the end of the slide table and grasped by the band grasping mechanism is released.

BRIEF DESCRIPTION OF THE DRAWINGS

Various other objects, features and attendant advantages of the present invention will become more completely understood when reference is made to the following detailed description, when considered in connection with the accompanying drawings, in which like reference characters designate like or corresponding parts throughout the characters designate like or corresponding parts throughout the several views, and wherein.

DETAILED DESCRIPTION OF THE PREFERRED EMBODIMENTS

Figure 4:
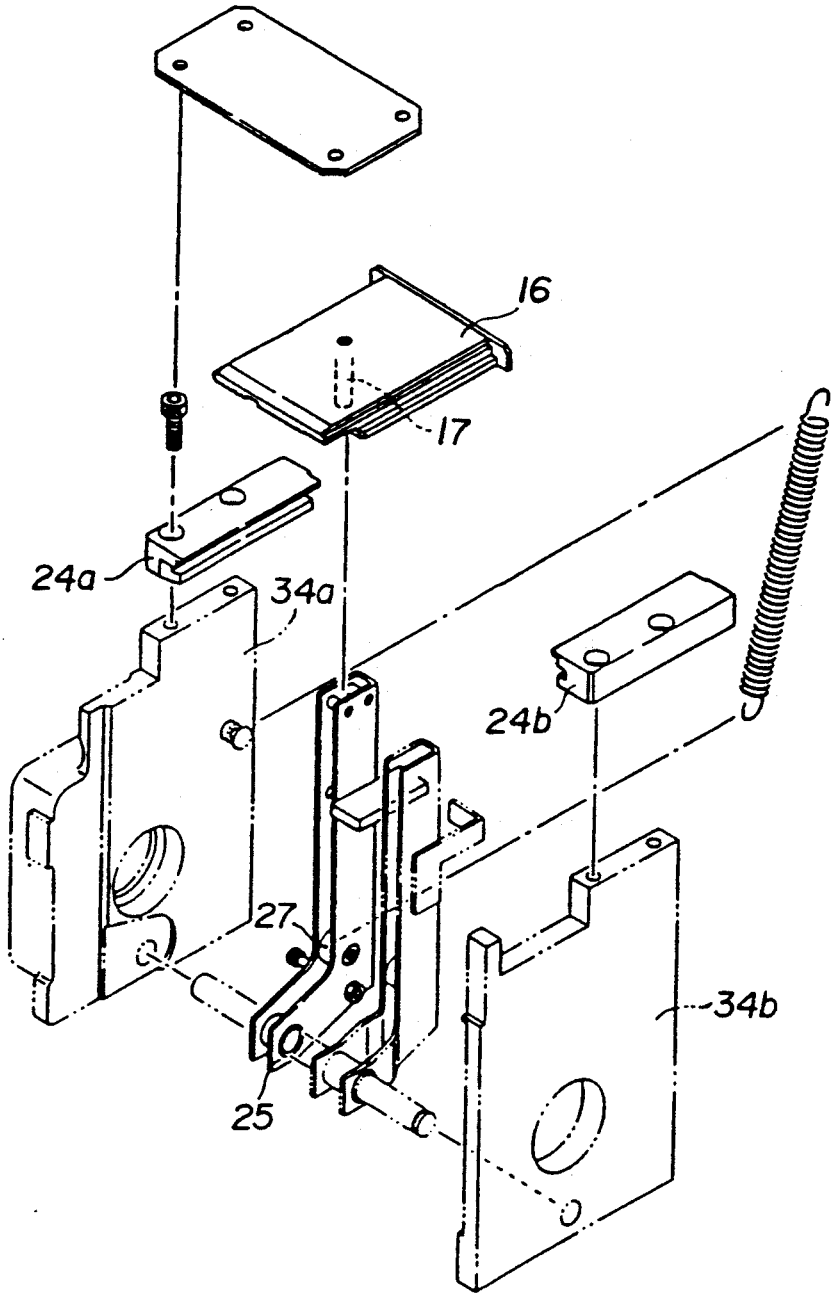
FIG. 4 is a perspective view relative to a slide table.
Figure 6:
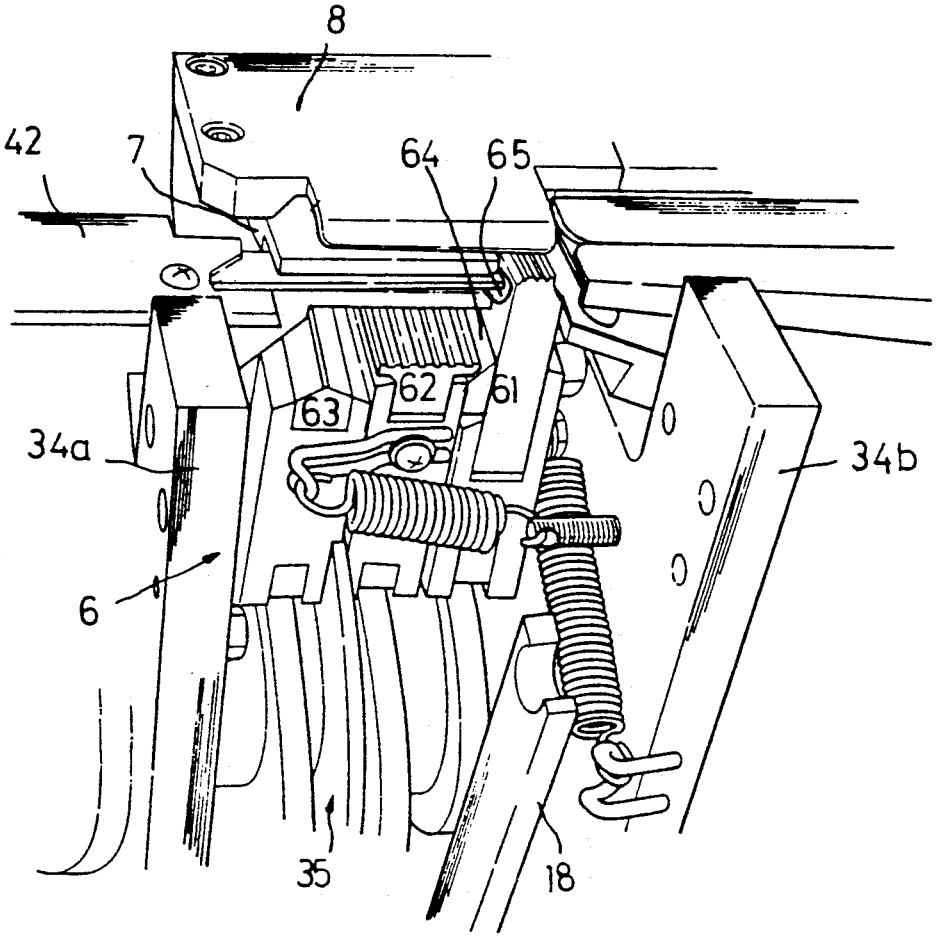
FIG. 6 is a perspective view showing an original position of each member.
Figure 8:
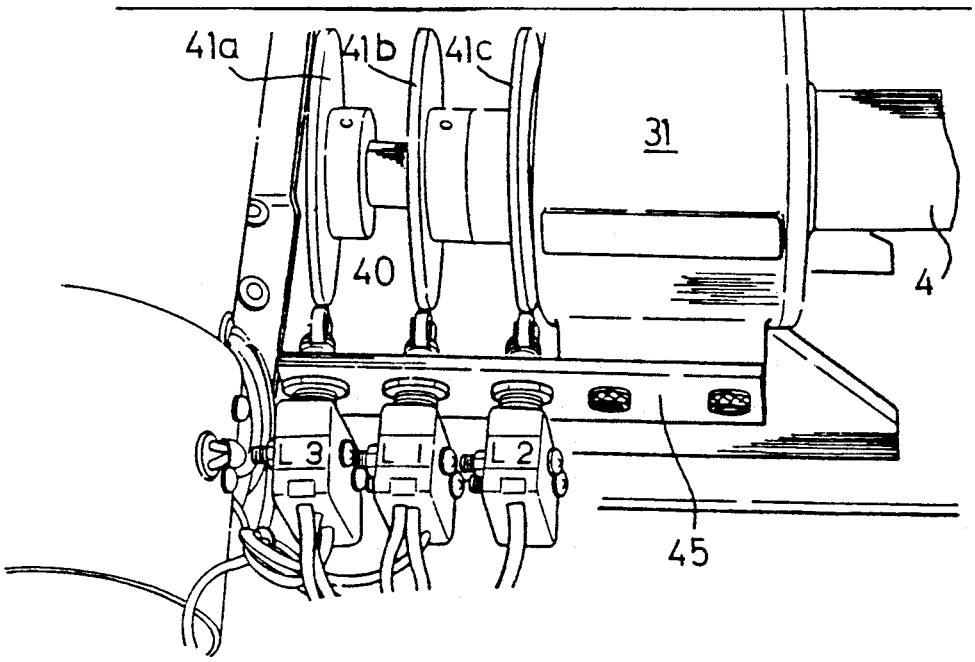
FIG. 8 is a perspective view of an essential portion of a controller.
Figure 7A:
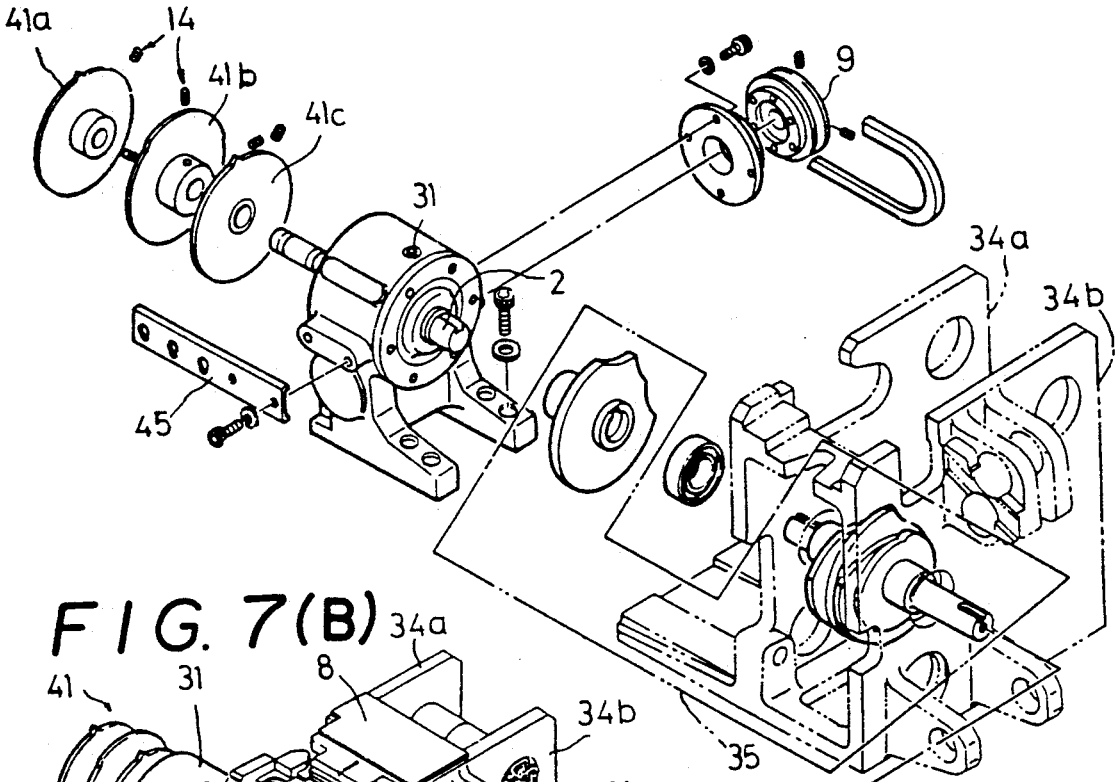
FIG. 7(A) is an exploded perspective view.
Figure 7B:
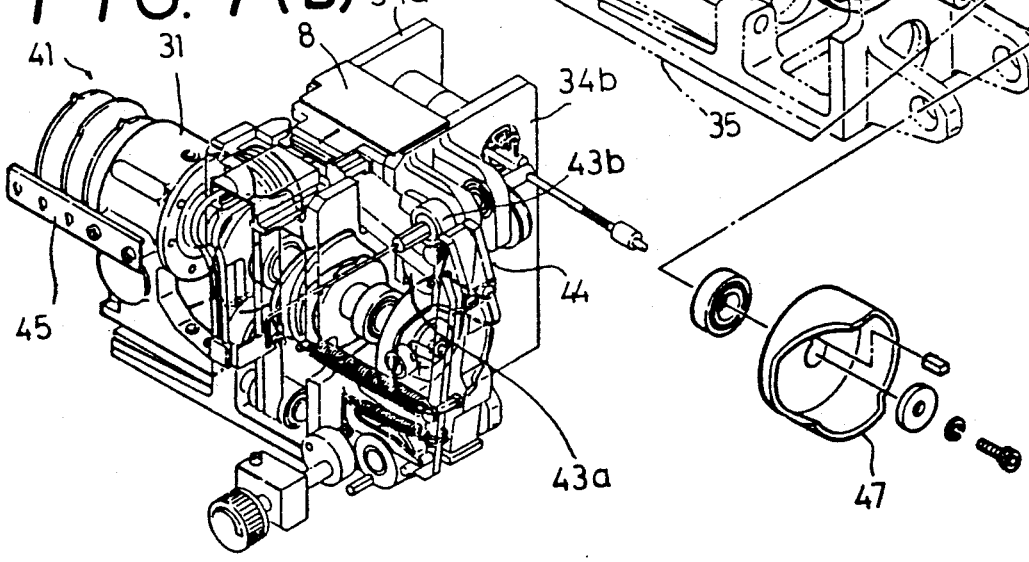
FIG. 7(B) is a perspective view.

A first embodiment of the present invention will be described with reference to the accompanying drawings by omitting the portions similar to those shown in FIGS. 6 to 8. In FIG. 4, both side edges of a slide table 16 are provided movably in slide contact with the grooves of guide rails 24*a* and 24*b* attached to the upper surfaces of frames 34*a* and 34*b*, and the end of the slide table 16 is so provided as to be telescopically moved from the end faces of the guide rails 24*a* and 24*b*. In other words, a pin 17 protrudes on the lower surface of the slide table 16, and the pin 17 is engaged with the upper end of a slide table arm 25 slidably provided through a roller 27 by means of the rotation of a cam (not shown) fixed to the cam shaft 4.

The mechanism is provided with a forward driving roller 10 which faces the band chute 1 and with a reverse rotation driving roller 20 spaced at a predetermined distance with respect thereto. A reduction motor 15 is directly connected to the drive shaft 11 of the forward rotation driving roller 10, and a gear 19 attached to the drive shaft 11 is meshed with a gear 26, of greater diameter than that of the gear 19, connected to the shaft 21 of the reverse rotation driving roller 20. Accordingly, the forward rotation driving roller 10 and the reverse rotation driving roller 20 always rotate in directions opposite to each other.

Figure 1:
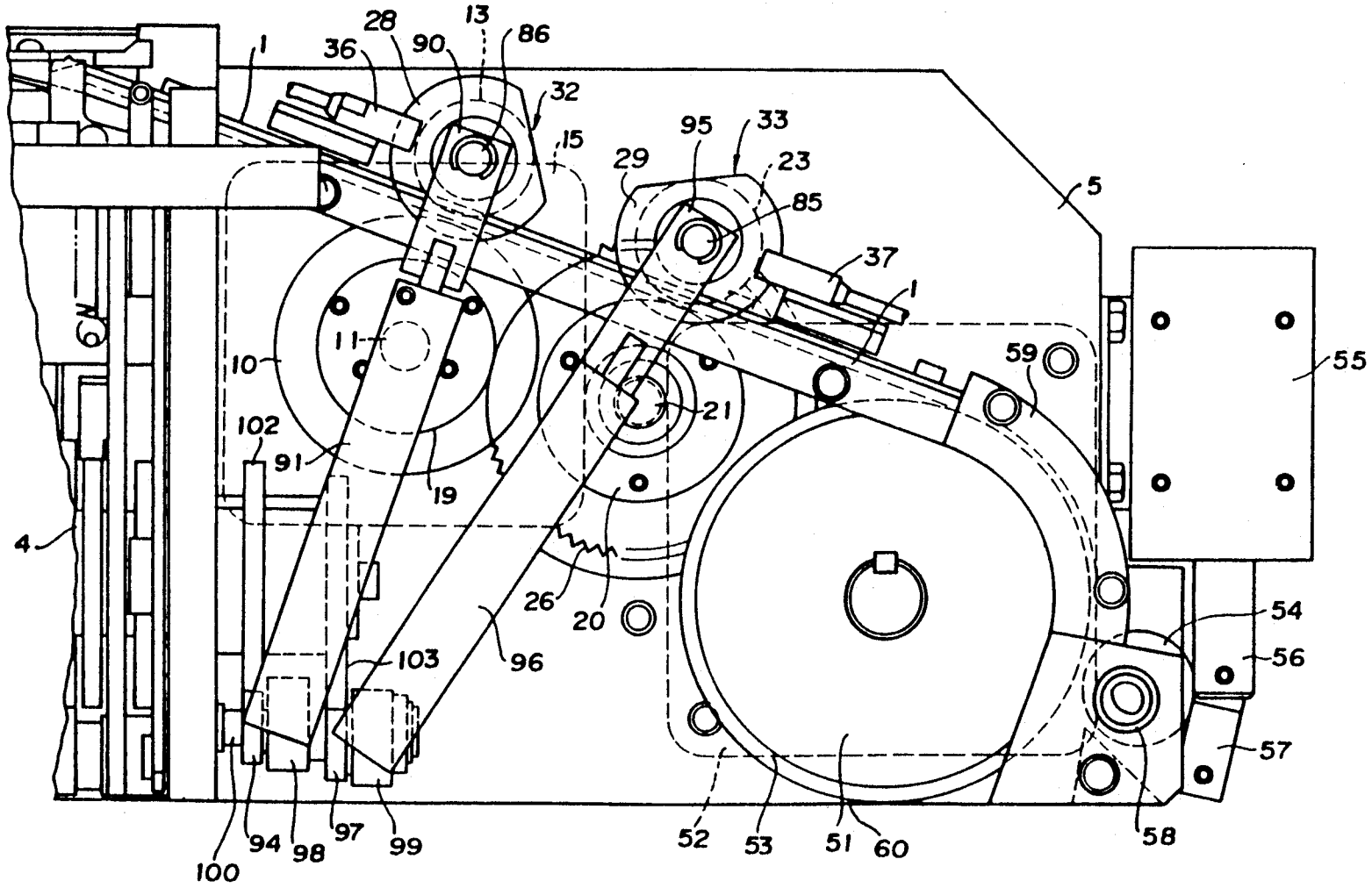
FIG. 1 is a front view of an essential portion.
Figure 3:
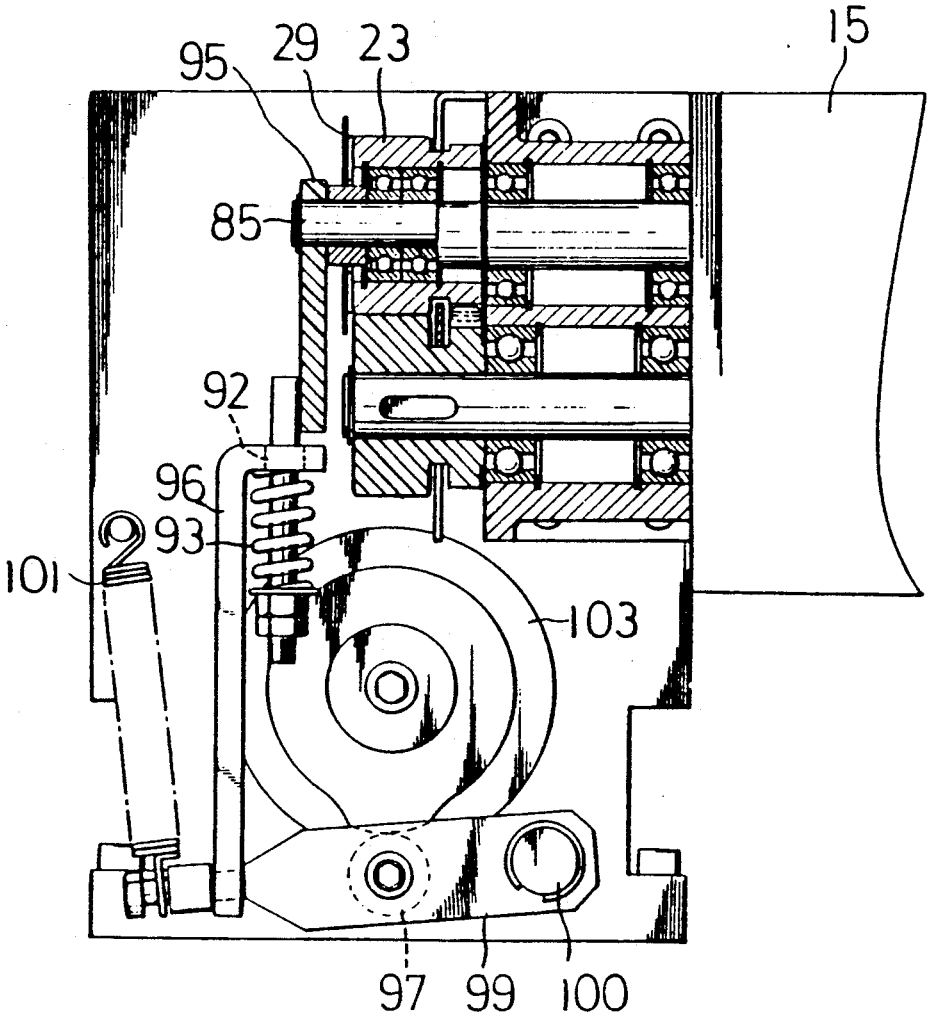
FIG. 3 is a partial sectional view.

Numerals 13 and 23 denote forward and reverse rotation touch rollers which are idle rollers and have a similar structure. The structure related to both touch rollers is described with reference to FIG. 3 showing the actuating mechanism of the forward rotation touch roller 13. Both of the touch rollers are supported by means of eccentric shafts 86 and 85, to the ends of which the upper ends of actuating levers 90 and 95 are pivotally attached. The lower ends of these levers 90, 95 are loosely inserted into holes 92 (92) bored through the bent sections of L-shaped interlocking levers 91 and 96 and connected to the actuating levers 90 and 95 through the intermediary of springs 93 (93). The lower ends of the actuating levers 90 and 95 are attached to the tips of arm levers 98 and 99 having rollers 94 and 97. One end of the arm levers 98 and 99 are pivotally supported by means of a shaft 100 projecting outwardly from a base plate, and springs 101 (101) is secured to the other end thereof so as to energize the spring in the direction of the band chute 1 (FIGS. 1 and 3).

Cams 102 and 103 are mounted upon a shaft which is an extension of a cam shaft 40 for actuating a band fusion mechanism composed of a known band gripper, a heater and a center press, and are brought into contact with the rolls 94 and 97 of the arm levers 98 and 99, respectively, so as to perform an interlocking action with the interlocking levers 91 and 96, or the actuating levers 90 and 95.

The compressive contact force developed by means of the actuating levers 90 and 95 which bring a forward rotation touch roller 13 and a reverse rotation touch roller 23 into compressive contact with the forward rotation driving roller 10 and the reverse rotation driving roller 20 by means of the cams 102 (and 103) through the intermediary of the interlocking levers 91 and 96 is variable to some degree by adjusting the drag or biasing force of the springs 93 (and 93) by rotating nuts 89 (and 89) disposed upon the lower portions of the spring 93 (and 93) and externally connected to the lower ends of the actuating levers 90 and 95. However, a predetermined degree of resistance applied to the band which travels or is restored reduces the speed of the rotation of the forward rotation touch roller 13 and the reverse rotation touch roller 23 and the forward rotation driving roller 10 and the reverse rotation driving roller 20 finally slip against the band thereby stopping the forward rotation touch roller 13 and the reverse rotation touch roller 23.

The above-described resistance actually refers to that produced when the front end of the band fed into the forward rotation driving roller 10 and the forward rotation touch roller 13 is caught within the arch or abuts against a slide table switch and also refers to that produced when the band is removed from the arch and would around an article to be strapped because of the reverse rotation of the reverse rotation driving roller 20 and the reverse rotation touch roller 23.

When the starting switch is turned ON, the cam shaft 4 and the cam 35 are rotated by means of the rotation of the cam shaft motor, and the end of the band is grasped fixedly between the slide table 16 and a right retainer 61, the arm lever 99 simultaneously presses down the interlocking lever 96 through the roll 97 by means of the cam 103, the actuating lever 95 brings the reverse rotation touch roller 23 into pressure contact with the reverse rotation drive roller 20 through the interlocking lever 96 thereby starting restoration of the band. A timer $T_2$ operated at this time is connected, for example, to the limit switch L1 of the prior art described previously.

Figure 2:
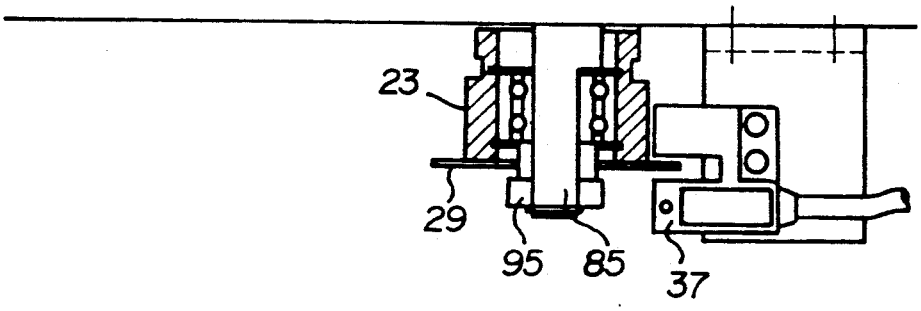
FIG. 2 is a schematic view of an arrow with a line A—A of FIG. 1.

Referring to FIGS. 1 to 3, the forward rotation touch roller 13 and the reverse rotation touch roller 23 are provided with rotary disks 30 and 31 which are partially cut-away, arc-shaped pulse-generating plates, and means 36 and 37 for detecting the speed of rotation, which are pulse generators integral therewith, are disposed at the rotation loci of the cut-away portions 32 and 33 of the rotary disks 30 and 31. The means for detecting the speed of rotation 36 and 37 are an access sensor, wherein a pulse is developed by turning the means ON when the cut-away portions 32 and 33 pass between the high-frequency-wave transmitting portion and the high-frequency-wave receiving portion of the means for detecting the speed of rotation 36 and 37 and the pulse is discharged from the capacitors respectively connected thereto, the same being finally charged by means of the respective capacitors by turning the means OFF when portions except for the cut-away portions 32 and 33 of the rotary disks 30 and 32 pass between the transmitting portion and the receiving portion. When the interval during which the pulses of the means for detecting the speed of rotation 36 and 37 are produced becomes longer, the rotating speed detecting means 36 and 37 are turned OFF and the capacitors-charging quantity exceeds the capacity to form an electronic circuit for developing the signal. The signal of the rotation speed-detecting means 36 turns ON a solenoid for bringing the band-tightening driving roller described later into contact or out of contact with the touch roller. The period during the development of the signal is arbitrarily adjusted by varying the capacity of the capacitor.

If the rotation speed reduction detection signal of the reverse rotation touch roller 23 by the rotation detecting means 37 is not generated within the setting time of the timer $T_2$ operating when the reverse rotation touch roller 23 starts reverse rotation for restoring and retracting the band, when the setting time of the timer $T_2$ is completed, the solenoid 55 is not turned ON, but a release signal for releasing the tightening step is generated. In other words, the tightening step is omitted after the setting time of the timer $T_2$ is elapsed, the cam shaft 4 is immediately rotated to be shifted to next steps of cutting and fusing the band supplying end.

A portion of the circumference of a tension roller 51 which is a band-tightening reverse rotation driving roller id disposed upon the rear end portion of the band chute 1 and is so constructed as to rotate at a lower speed and higher torque than the reverse rotation driving roller 20 which rotates at a lower speed and higher torque than that of the forward rotation drive roller 10. A portion of the circumference of the tension roller 51 corresponding to the above-described return roller is disposed at the rear end of the band chute 1 and the drive shaft 22 of the tension roller 51 is directly connected to tightening motor 51 composed of a brake-equipped geared motor attached to the reverse side of a base plate 5. As shown in FIG. 1, the tension roller 51 is a large-diameter roller which is fabricated from an elastic material which exhibits a large friction resistance, such as, for example, urethane (hereinafter called "elastic body"), and is adhered to the outer periphery of the metallic roller. The center region, as seen in the width direction of the outer peripheral surface of the elastic body 53 is provided with a notch within which an annular member 60 comprising a thrust washer formed by coating a metal material which is harder and has a smaller friction resistance than that of the elastic body, such as, for example, stainless steel is embedded. The annular member 60 projects outwardly from the outer periphery of the elastic body 53 by means of a slight distance such as 0.2 to 0.3 mm.

A tension touch roller 54 is supported by means of an eccentric shaft 58, and the other end of a crank 57, one end of which is connected to the rod 56 of a solenoid 55 connected to a timer $T_2$, is supported on the head of the eccentric shaft 58. The outer periphery of the tension touch roller 54 is so constructed as to be capable of achieving compressive contact with and separation from the outer periphery of the tension roller 51 by means of expansion and contraction of the rod 56.

A guide chute 59 covers a portion of the outer periphery of the tension roller 51 through the intermediary of a gap for allowing the band to pass therethrough. One end thereof faces the rear end of the band chute 1 and the other end thereof faces a portion of the outer periphery cf the tension touch roller 54.

The timer $T_1$ which is connected to the solenoid 55 is set to a time necessary for firmly tightening the band wound around the article to be strapped.

The band is wound around an article to be strapped through means of a band guiding arch (not shown) disposed upon the main body of a strapping machine or manually and the leading end of the band reaches a slide table 16. Because the convex portion of the cam 102 is not disposed at a position at which the same biases the roller 94 downwardly, a gap having a thickness at least exceeding the thickness of the band is defined between the forward rotation driving roller 10 and the forward rotation touch roller 13, such that there is no effect upon the band within the band chute 1. The relation between the reverse rotation driving roller 20 and the reverse rotation touch roller 23 is also the same as noted above with respect to rollers 10 and 13. In this case, a cam shaft 4 is pivotally rotated by means of a starting switch and the leading end of the band is grasped by means of the mechanism for holding the band leading end within the band fusion-bonding mechanism. Because of the cam which is simultaneously rotating, the actuating lever 95 is moved downwardly through the intermediary of the roll 97, the arm lever 99, and the interlocking lever 96. The eccentric shaft pivotably rotates in the form of an arc so as to move the reverse rotation touch roller 23 downwardly by means of the eccentric shaft thereby bringing the same into compressive contact with the reverse rotation driving roller 20. Accordingly, the band-feeding end within the band chute 1 is restored by means of a pair of rollers at high speed (the primary tightening).

Simultaneously, the limit switch L1 is turned ON by the limit cam **41*b* rotated in synchronism with the cam shaft 4, and the timer $T_2$ connected to the limit switch L1 starts operation. The setting time of the timer $T_2$ is so set as to complete before the slide table 16 is tightened when the band is removed from the arch and wound on the slide table 16**.

The tension roller 51 has already started rotation by means of the tightening motor 52 at the same time that band restoration by means of the reverse rotation driving roller 20 and the reverse rotation touch roller 23 is occurring. The restored band travels while smoothly sliding around the annular member 60 having a low friction coefficient disposed within the outer periphery of the elastic body 53 of the tension roller 51 within the guide chute 59.

In case of normal strapping process, when the band is removed from the arch so as to be wound around the article to be strapped, the reverse rotation touch roller 23 applies resistance to the band against the reverse rotation movement, such that the rotation is gradually slowed down and the rotation speed of the rotary disk 31 is reduced. When the pulse-developing interval defined by means of the rotation speed-detecting means 37 becomes longer and the charging quantity into the capacitor exceeds an arbitrarily adjusted capacity, a signal is produced and the signal excites the solenoid 55 through the intermediary of the timer $T_1$ whereby the tension touch roller 54 upon the eccentric shaft 58 is brought into compressive contact with the tension roller 51 through the intermediary of the crank 57. In this case, the annular member 60 upon the elastic body 53 of the tension roller 51 is pressed into the elastic body 53 through the intermediary of the band at a position at which the tension touch roller 54 is brought into contact with the elastic body 53 because of the compressive contact of the tension touch roller 54 and on the peripheral surface upon which the band is wound around the elastic body 53 whereby the band is tightened by means of the peripheral surface of the elastic body having a large friction resistance during a predetermined period of time of timer $T_1$.

The cam shaft 4 is rotated by means of the signal, the arm lever 99 is vibrated to release the compressive contact of the reverse rotation touch roller 23 with the reverse rotation driving roller 20, and the cam shaft 4 is stopped.

When the band is firmly wound around the article to be strapped the aforesaid timer $T_1$ produces a tightening completion signal by means of a timing-out operation, which causes the tightening motor 52 to stop. The cam shaft 4 rotates again so as to grasp the band-feeding end and to terminate the excitation of the solenoid 55. The rotation of the cam shaft 4 swings the arm lever 99 whereby the compressive contact of the reverse rotation touch roller 23 with the reverse rotation driving roller 20 is relieved so as to form a gap to such a degree that there is freedom of contact with the band between the respective rollers within the band chute 1. The cam shaft 4 which continues rotation performs fusion of the band-joining portion and cutting of the supplying end by means of the band fusion mechanism.

However, in case where an idle strapping has occurred, the rotating speed of the reverse rotation touch roller 23 is not reduced until the band is removed from the arch and wound on the slide table 16. In other words, since the rotation speed of the speed reducer 31 is not reduced, the charging quantity in the capacitor does not pass the arbitrarily regulated capacity, and a rotation speed reduction signal is not generated. When the setting time of the timer $T_2$ is completed in this state, a signal for omitting tightening is generated, and similar operation to a tightening end signal generated upon completion of the setting time of the timer $T_2$ occurs. More specifically, the tightening motor 52 is stopped by this signal, and the operation is shifted to next steps of grasping, cutting and fusing of the band supplying end. The band is wound on the periphery of the end of the slide table 16, and a band ring not tightened by the tightening mechanism is formed. The cam shaft 4 is then rotated to fly out the band, and the band is automatically removed.

Rotation of the cam shaft 4 disposes the forward driving roller 10 and the forward rotation touch roller 13 toward the state as shown in FIG. 3 whereby the cam can compressively contact the band between both rollers and thereby feed a predetermined amount of the band to the upper surface of the main body. When the leading end of the band abuts against the slide table switch disposed upon the lower portion of the slide table 8, the switch signal causes the cam shaft 4 to rotate again and stop at a point where the respective members return to their original positions.

Figure 5:
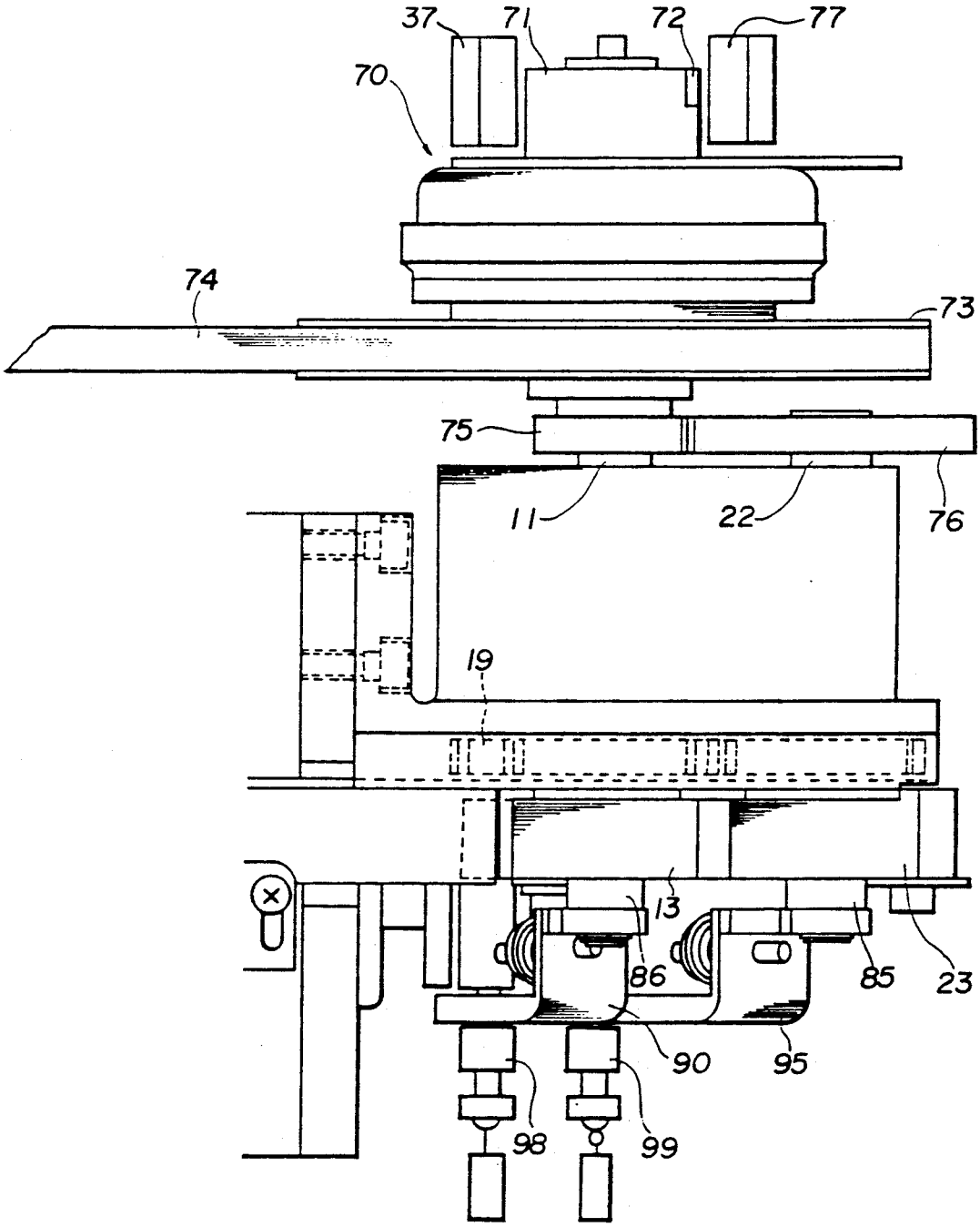
FIG. 5 is a plan view of a second embodiment.

A second embodiment of the present invention will be described with reference to FIGS. 1, 3 and 5. The portions similar to those in the first embodiment are omitted, and the tightening mechanism of the first embodiment will be described instead of the following arrangement.

A pulley 73 of a prime drive wheel is provided on the drive shaft 11 of the forward rotation driving roller 10 through an electromagnetic clutch 70, and the pulley 73 is connected to a motor (not shown) through a V-belt 74. A gear 75 is provided at the pulley 73 side of a prime drive wheel on the drive shaft 11. A gear 76 provided at a drive shaft 22 of a reverse rotation driving roller 20 is meshed with the gear 75 so that both the rollers rotate reversely to each other, and the reverse driving roller 20 is supported through a one-way clutch to rotate only in a tightening direction. In the embodiment shown in the drawings, the gear 76 of a reverse rotation roller has a large diameter so as to obtain a high torque at a low speed at the time of tightening. In FIG. 5, the electromagnetic clutch 70 is attached to the drive shaft 11 of the forward rotation driving roller 10 by means of a retaining ring 71 provided at the end of the shaft 11, and a magnet 72 is embedded in the retaining ring 71. Numerals 37 and 77 denote means for detecting rotation, which is connected to a rotation detector for detecting the rotation speed of the shaft 11 by means of the magnet 72 to produce an output signal when the rotation speed decreases lower than a predetermined rotation speed.

The rotation detecting means 37 detects a reduction in a slight rotation in the primary tightening, i.e., when the restored and retracted band is wound on the article to be strapped. In case of detection of a decrease in the speed of the drive shaft 11 by means of the rotation detecting means 37 within the setting time of the timer $T_2$, the process is shifted to a normal secondary tightening step. In case of no detection of the decrease in the speed of the shaft within the setting time of the timer $T_2$, the excitation of the coil of the electromagnetic clutch 70 is interrupted to omit the secondary tightening. The rotation detecting means 77 detect the secondary tightening, i.e., a reduction in the rotation of the shaft when the article to be strapped is wound by the band by means of further strong tightening force after the primary tightening.

Therefore, when the band is started to be restored and retracted by the pair of rollers 20 and 23 for rotatably driving the band, the timer $T_2$ is operated. When the band is wound on the article to be strapped within the setting time of the timer $T_2$, a resistance is applied to the band thereby applying a load to the clutch 70 through the drive shaft 11 so that the rotation of the retaining ring 71 is slightly reduced. The reduction in the rotation of the ring 71 is detected by the rotation detecting means 37 which produces a signal thereby shifting to a normal strapping step. In other words, the band is immediately tightened to the article to be strapped up to the set tightening torque by means of the tightening setting voltage of the electromagnetic clutch 70. Then, an armature (not shown) in the electromagnetic clutch 70 is slipped with respect to a rotor through the gear 75 on the shaft 11 in mesh with the gear 76 of the reverse rotation driving roller 20. In other words, since the rotation of the reverse rotation driving roller 20 is reduced and is finally tended to be stopped, and the shaft 22 and hence the shaft 11 is tended to be stopped. Thus, the armature attracted to the rotor by means of a predetermined magnetic force by the set voltage is slipped against the magnetic force so that the rotation of the pulley 73 of a primary drive wheel is not transmitted to the shaft 11.

At this time, the rotation of a magnet 72 in the retaining ring 71 provided at the end of the drive shaft 11 is reduced, and finally stopped. Accordingly, the rotation detecting means 77 provided near the rotation locus of the magnet 72 generates a detection signal for detecting that the rotation of the drive shaft 11, i.e., the reverse rotation driving roller 20 is reduced (including a stop) to interrupt the excitation of the coil of the electromagnetic clutch 70 by means of the signal thereby stopping the transmission of the power to the drive shaft 11. At this time, the force for restoring and retracting the band to the reverse rotation driving roller 20 is actuated by means of tension applied to the already tightened band, but the shaft 21 of the reverse rotation driving roller 20 is supported through a one-way clutch rotating only in the tightening direction, and the tightened band is fixed between both the rollers 23 and 20. Simultaneously, the cam shaft 4 is rotated by means of the detection signal, and grasping, cutting and fusing steps of the band supplying end similar to those of the first embodiment are executed.

In case of idle strapping, the rotation detecting means 37 does not detect the reduction in the rotation within the setting time of the timer $T_2$. Therefore, the excitation of the coil of the electromagnetic clutch 70 is interrupted, the band tightening step is ended in the state that the band is wound on the slide table 16 by means of weak force, and thereafter the aforesaid normal strapping step is conducted. Further, the removal of the band from the band fusing mechanism is operated similarly to that of the first embodiment.

A third embodiment of the present invention will be described by omitting the similar portions shown in FIGS. 6 to 8 and the first embodiment.

In this third embodiment, a band tightening mechanism is the aforesaid tension arm type, a mechanism regarding a slide table 16 is similar to that in the embodiment shown in FIG. 4, and the arrangement except those described below is similar to that of the embodiment shown in FIGS. 6 to 8.

A cam shaft motor connected to a cam shaft 4 for actuating the press member is normally and reversely rotatable, and is, for example, composed of a normally and reversely rotatable brake-equipped geared motor. An output shaft 2 may be connected integrally with or directly to the cam shaft 4. In a band restoring and retracting mechanism, a rotary disk 29 and rotation detecting means 37 similar to those in the first embodiment are provided at the reverse rotation touch roller 43*b* of a feed roller 43*a*, and a timer $T_2$ actuating when the band restoration is started similarly to that of the first embodiment is connected to a limit switch L1. After the setting time of the timer $T_2$ is completely elapsed, the reverse rotation of the motor connected to the feed roller 43 is stopped, and the cam shaft 4 is normally rotated.

A limit cam 41*c* is attached to a limit cam shaft 40 extended to the output shaft 2, and a limit switch L4 is attached to a position in which a rod is inserted by the convex portion of the limit cam 41*c* through a bracket 45. After the cam shaft 4 is rotated to raise the middle press 63 of a press member 6 to cut the band supplying end, the convex portion of the limit cam 41*c* turns ON the limit switch L4 before the band joined portion is not pressed.

When the rotation of a rotary disk 29 is reduced, the limit switch L4 and a circuit for reversely rotating a cam shaft motor for rotatably driving the cam shaft 4 to be described later are interrupted by means of a signal generated from rotation detecting means 37, and the cam shaft 4 is simultaneously normally rotated. In case when a rotation reduction detection signal is not generated from the rotation detecting means 37 within the setting time of the timer $T_2$, when the limit switch L4 is turned ON, a preliminary state in which the reverse rotation circuit of the cam shaft 4 is connected to a power source occurs. That is, when the limit switch L4 is turned ON by means of the normal rotation of the cam shaft 4 after the setting time of the timer $T_2$ is elapsed, the normal rotation circuit of the cam shaft 4 is interrupted, and the reverse rotation circuit of the cam shaft 4 is excited.

The operation of the third embodiment will be described by omitting the similar portions to those in the first embodiment and in the aforesaid prior art.

When the band is restored and retracted from the arm and wound around an article to be strapped, the rotation of the rotary disk 29 attached to the reverse rotation touch roller is reduced. Accordingly, the reverse rotation of a motor connected to the feed roller 43 is stopped by means of a detection signal generated from the rotation detecting means 37, the cam shaft 4 is normally rotated to tighten the band by means of the tension arm 44. Then, the strapping step similar to that in the aforesaid prior art is conducted. On the other hand, in case of an idle strapping, since a rotation reduction detection signal is not generated from the rotation detecting means 37 in the meantime until the setting time of the timer $T_2$ is completely elapsed similarly to that of the first embodiment, the reverse rotation of the motor for rotatably driving the feed rollers 43*a* and 43*b* is stopped when the setting time of the timer $T_2$ is completely elapsed, and the cam shaft motor connected to the cam shaft 4 is normally rotated. The tension arm 44 is slid by means of the tension cam 47 upon normal rotation of the cam shaft motor, the band is tightened by the upper grasping mechanism of the tension arm 44 to tighten the slide table 16. Then, the right retainer 61 of the press member 6 is raised to grasp the band supplying end side, a heater is inserted between the band joined portions, the middle press 63 is raised, and the band of the band supplying end side is cut by means of the upper edge of the cutter of the right retainer 61 and the lower edge 64 of the cutter provided at the middle retainer 63. Then, the middle press 63 tends to further rise so as to press the fused band between the band joined portions. The convex portion of the limit cam 41*d* pressed the rod of the limit switch L4 to turn it ON before the middle press 63 presses the band. The normal rotation of the cam shaft 4 is interrupted by this signal, and the reverse rotation circuit of the cam shaft 4 is excited. Accordingly, the cam shaft 4 is stopped, reversely rotated and rotated to the original position. Then, the band which tightens the slide table 16 and is cut at the supplying end is relieved from the tightening state of the sectional shape of the slide table when the right retainer 61 and the left retainer 62 are moved down. Accordingly, the band is recoiled above the slide table 16 by means of the elastic force of the band itself tending to be returned to a plane state and removed out of the band fusing mechanism.

What is claimed is:

1. A method of removing an idle strapping band for a strapping machine having band supplying, restoring and tightening mechanisms for strapping including an elasticity in a body and the steps of inserting the leading end of a band fed by said band supplying mechanism and wound around the body between the end of a slide table telescopic on the joined positions of the leading end and supplying end of the band and a press member, grasping the leading end of the band by the band end grasping mechanism, then restoring the leading end of the band by the band end grasping mechanism, tightening the band to be wound around an article to be strapped and tightened, grasping the band supplying end side, then cutting the band supplying end, and fusing the band joined portions comprising the steps of:

setting the setting time of a timer actuating when said reverse rotation roller starts reverse rotation for restoring and retracting the band to a period of time after the band restored and retracted by said reverse rotation roller in case of idle strapping is wound around the leading end of said slide table before the slide table is tightened, omitting a band tightening step when a rotation reduction detection signal of said reverse rotation roller is not generated within the setting time of this timer, cutting the band supplying end and fusing the band joined portions, winding the band around the leading end of the slide table to form a ring of the band, then removing the ring of the band from the end of the slide table by means of the retraction of both side edges of the slide table in slide contact with guide rails, and removing the band out of the slide table by means of the elastic force of the band itself.

2. A method of removing an idle strapping band for a strapping machine according to claim 1, wherein said band restoring and retracting step is conducted by a reverse rotation driving roller reversely rotated by means of rotatably driving means and a touch roller rotated to be driven in slide contact with the reverse rotation driving roller through the band, and said band tightening step is executed by the touch roller to be brought into slidable contact with the reverse rotation driving roller by means of a solenoid.

3. A method of removing an idle strapping band for a strapping machine according to claim 1, wherein the ring of said band is removed out of the slide table by bringing both side edges of said slide table into slide contact with the guide rails.

4. A method of removing an idle strapping band for a strapping machine according to claim 2, wherein, when a rotation reduction detection signal of said reverse rotation driving roller is not generated within the setting time of said timer, the solenoid of said touch roller is not excited, the touch roller is not brought into pressure contact with the reverse rotation driving roller, and the band tightening step is omitted.

5. A method of removing an idle strapping band for a strapping machine according to claim 1, wherein said band restoring and retracting step is conducted by a reverse rotation driving roller rotatably supported in a tightening direction and a touch roller slidable contact with the reverse rotating driving roller.

6. A method of removing an idle strapping band for a strapping machine according to claim 5, wherein a rotation reduction detection signal of said reverse rotation driving roller is produced by detecting the rotation reduction of an electromagnetic clutch provided at a reverse rotation driving shaft.

7. In a method of removing an idle strapping band for a strapping machine having band supplying, restoring and tightening mechanisms for strapping including an elasticity and the steps of inserting the leading end of a band fed by said band supplying mechanism and wound around the body between a slide table and a press member, grasping the leading end of the band by the band end grasping mechanism, then restoring the leading end of the band by the band end grasping mechanism, winding the band around an article to be strapped, tightening the band to be wound around an article to be strapped and tightened, grasping the band supplying end side, then cutting the band supplying end, and fusing the band joined portions, said band tightening step including connecting a tension cam to a cam shaft for actuating said press member connected with normally/reversely rotatably driving means, and conducting by means of a tension arm slid at a predetermined stroke by said tension can and automatically restored by a spring, comprising the steps of setting the setting time of a timer actuating when said reverse rotation roller starts reverse rotation for restoring and retracting the band to a period of time after the band restored and retracted by said reverse rotation roller in case of idle strapping is wound around the leading end of said slide table before the slide table is tightened, normally rotating said cam shaft when a rotation reduction detection signal of said reverse rotation roller is not generated within the setting time of this timer, grasping the band supplying end side after a tightening step by means of the side of said tension arm and cutting the band supplying end, then stopping the normal rotation of said cam shaft before a fusing step of the band by a band fusing mechanism, then reversely rotating said cam shaft to restore said press member to an original position, and removing the band wound around the end of the slide table out of the slide table by means of the elastic force of the band itself.

8. A method of removing an idle strapping band for a strapping machine according to claim 7, wherein, when a rotation reduction detection signal of said reverse rotation driving roller is not generated within the setting time of said timer, said cam shaft is reversely rotated by means of a signal for detecting that said cam shaft is disposed immediately before the joined portion is pressed by means of the press member, and said press member and said tension arm are restored at original positions.

* * * * *